US010160590B2

(12) United States Patent
Wells et al.

(10) Patent No.: US 10,160,590 B2
(45) Date of Patent: Dec. 25, 2018

(54) VENTED NON-COLLAPSING CONTAINERS, DISPENSERS AND REFILL UNITS HAVING VENTED NON-COLLAPSING CONTAINERS

(71) Applicant: GOJO Industries, Inc., Akron, OH (US)

(72) Inventors: Jesse D. Wells, Canton, OH (US); Aaron D. Marshall, Uniontown, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 0 days.

(21) Appl. No.: 14/628,478

(22) Filed: Feb. 23, 2015

(65) Prior Publication Data

US 2015/0239644 A1 Aug. 27, 2015

Related U.S. Application Data

(60) Provisional application No. 61/943,678, filed on Feb. 24, 2014.

(51) Int. Cl.
*B65D 83/38* (2006.01)
*B65D 83/16* (2006.01)
(Continued)

(52) U.S. Cl.
CPC ..... *B65D 83/38* (2013.01); *A47K 5/1207* (2013.01); *B05B 11/0018* (2013.01);
(Continued)

(58) Field of Classification Search
CPC ..... A74K 5/14; A74K 5/1211; A74K 5/1207; B05B 11/0018; B05B 11/3087; B05B 11/0054
(Continued)

(56) References Cited

U.S. PATENT DOCUMENTS 585,327 A 6/1897 Guttenberg
922,453 A 5/1909 Burgner
(Continued)

FOREIGN PATENT DOCUMENTS

CH 676227 12/1990
DE 102008034244 A1 3/2010
(Continued)

OTHER PUBLICATIONS

Office Action from U.S. Appl. No. 14/327,975 dated May 7, 2015.
(Continued)

*Primary Examiner* — Lien Ngo

(74) *Attorney, Agent, or Firm* — Calfee, Halter & Griswold LLP

(57) ABSTRACT

Exemplary embodiments of dispensers and refill units are disclosed herein. An exemplary refill unit for a soap, sanitizer or lotion includes a non-collapsing container. The non-collapsing container includes a neck. An annular projection is located at least partially on the neck. A one-way valve is located proximate the annular projection. The one-way valve allows air to flow into the non-collapsing container once the vacuum pressure in the container reaches the cracking pressure of the one-way valve and the one-way valve prevents liquid from flowing out of the annular projection. In addition, a pump for pumping the contents of the container out of the container is also included.

22 Claims, 3 Drawing Sheets

(51) Int. Cl.
*B65D 83/70* (2006.01)
*B05B 11/00* (2006.01)
*A47K 5/12* (2006.01)

(52) U.S. Cl.
CPC ..... *B65D 83/16* (2013.01); *B65D 83/70* (2013.01); *B05B 11/0054* (2013.01); *B05B 11/3087* (2013.01)

(58) Field of Classification Search
USPC ..... 222/325, 332, 181.1, 621, 190, 402.1, 222/321.1, 321.6–321.9; 417/472
See application file for complete search history.

(56) References Cited

U.S. PATENT DOCUMENTS 1,167,420 A 1/1916 Marcuse
1,207,278 A 12/1916 Cordley
1,207,505 A 12/1916 Cordley
1,220,753 A 3/1917 Kees
1,303,708 A 5/1919 Moffitt
1,553,113 A 9/1935 Amos
2,464,030 A 3/1949 Engstrom
2,529,365 A 11/1950 Barksdale
2,605,021 A 7/1952 Spencer et al.
2,746,651 A 5/1956 Lewis
2,770,234 A 11/1956 Nesset et al.
2,851,201 A 9/1958 Poitras
2,904,222 A 9/1959 Philippe
3,200,994 A 8/1965 Levinson et al.
3,215,319 A 11/1965 Laker
3,239,151 A 3/1966 Boris-Nee Jekelson
3,361,078 A 1/1968 Cooprider
3,628,704 A 12/1971 Corsette
3,674,181 A 7/1972 Marks et al.
3,790,034 A * 2/1974 Horvath ..... B05B 9/0883 222/153.13
3,851,801 A 12/1974 Roth
4,057,176 A 11/1977 Horvath
4,142,653 A 3/1979 Mascla et al.
4,168,020 A 9/1979 Benson
4,183,449 A 1/1980 Blake
4,249,676 A 2/1981 Beery
4,272,019 A * 6/1981 Halaby, Jr. ..... B05B 7/10 141/351
4,321,938 A 3/1982 Siller
4,330,071 A 5/1982 Gustav
4,360,130 A 11/1982 Nishimura et al.
4,410,107 A 10/1983 Corsette
4,493,440 A 1/1985 von Buelow et al.
4,597,511 A 7/1986 Licari
4,646,945 A 3/1987 Steiner
4,694,976 A 9/1987 Scheutz
4,793,522 A 12/1988 Corsette
4,798,311 A 1/1989 Workum
4,880,161 A 11/1989 Wright
4,930,667 A 6/1990 Holzner, Sr.
4,932,561 A 6/1990 Boxall
4,986,453 A 1/1991 Lina et al.
4,997,429 A 3/1991 Dickerhoff et al.
5,033,654 A 7/1991 Bennett
5,037,006 A 8/1991 Kock
5,082,150 A 1/1992 Steiner
5,086,950 A 2/1992 Crossdale
5,110,052 A 5/1992 Graf et al.
5,238,187 A 8/1993 Ziotnik et al.
5,271,530 A 12/1993 Uehira et al.
5,282,552 A 2/1994 Ophardt
5,310,094 A 5/1994 Martinez et al.
5,398,845 A 3/1995 Meyer
5,439,140 A 8/1995 Meyer
5,443,569 A 8/1995 Uehira et al.
5,445,288 A 8/1995 Banks
5,458,289 A 10/1995 Cater
5,462,208 A * 10/1995 Stahley ..... B05B 7/0037 222/190
5,489,044 A 2/1996 Ophardt
5,503,306 A 4/1996 Knickerbocker
5,507,417 A 4/1996 Webb
5,544,788 A 8/1996 Meyer
5,549,224 A 8/1996 Wu
5,664,703 A 9/1997 Reifenberger
5,676,277 A 10/1997 Ophardt
5,727,715 A 3/1998 McKenna
5,752,627 A 5/1998 Vandromme
5,826,755 A 10/1998 Burd
5,899,363 A 5/1999 Bliss, III et al.
5,906,299 A 5/1999 Hagleitner
5,927,559 A 7/1999 Bommer et al.
5,862,954 A 12/1999 Ehrensperger
6,016,936 A 1/2000 Fan
6,053,364 A 4/2000 van der Heijden
6,065,647 A 5/2000 Bliss, III et al.
6,082,586 A 7/2000 Banks
6,142,750 A 11/2000 Benecke
6,244,472 B1 6/2001 Hennemann
6,378,742 B1 4/2002 Rohr et al.
6,386,403 B2 5/2002 Parson et al.
6,446,840 B2 9/2002 Ophardt et al.
6,540,111 B2 4/2003 Sunnarorg
6,664,516 B2 12/2003 Chang
6,669,060 B2 * 12/2003 De Laforcade ..... B05B 11/0018 137/854
6,688,499 B2 2/2004 Zhang
6,921,004 B1 7/2005 Knickerbocker
6,971,549 B2 12/2005 Leifheit et al.
6,986,443 B2 1/2006 Laible
7,004,356 B1 * 2/2006 Sayers ..... B05B 7/0037 222/137
7,021,494 B2 4/2006 Mazooji et al.
7,040,511 B1 5/2006 Petit
7,048,136 B2 5/2006 Havens
7,059,282 B2 6/2006 Vorih et al.
7,303,098 B2 12/2007 Backes
7,308,990 B2 12/2007 Mazooji et al.
7,325,704 B2 2/2008 Kasting
7,337,930 B2 3/2008 Ophardt et al.
7,377,758 B2 5/2008 Sallows et al.
7,461,762 B2 12/2008 Law
7,543,722 B2 8/2009 Yates
7,641,007 B2 1/2010 Law et al.
7,708,166 B2 5/2010 Ophardt
7,735,692 B2 6/2010 Nelson
7,806,301 B1 10/2010 Ciavarella et al.
7,815,076 B2 10/2010 Ophardt
7,938,297 B2 5/2011 Law et al.
7,959,035 B2 * 6/2011 Pruvot ..... B05B 11/0016 128/200.22
8,002,150 B2 8/2011 Ophardt et al.
8,047,403 B2 11/2011 Quinlan et al.
8,047,404 B2 11/2011 Quinlan et al.
8,272,539 B2 9/2012 Ophardt et al.
8,474,664 B2 7/2013 Ophardt et al.
8,523,024 B2 9/2013 Piscopo et al.
8,550,378 B2 10/2013 Mazooji
8,579,159 B2 11/2013 Ciavarella
8,596,501 B2 12/2013 Hagleitner
8,602,263 B2 12/2013 Baron et al.
8,662,356 B2 3/2014 Padain et al.
8,733,588 B2 5/2014 Ophardt et al.
8,875,952 B2 11/2014 Ciavarella
8,955,718 B2 2/2015 Ciavarella
9,038,862 B2 5/2015 McNulty
9,504,360 B2 11/2016 Van Diepen et al.
9,648,992 B2 5/2017 Harris
2002/0000450 A1 1/2002 Brown
2002/0153389 A1 10/2002 Creghan et al.
2002/0179735 A1 12/2002 Santagiuliana
2003/0000967 A1 1/2003 Ehrensperger
2004/0031816 A1 2/2004 Schuman
2004/0065689 A1 4/2004 Pritchett
2004/0206772 A1 10/2004 Leifheit
2005/0072805 A1 4/2005 Matthews

(56) References Cited

U.S. PATENT DOCUMENTS

2005/0109798 A1* 5/2005 Kasting ..... B05B 11/0016 222/321.9
2005/0205600 A1 9/2005 Ophardt et al.
2005/0224519 A1 10/2005 Law
2005/0230414 A1 10/2005 Yoshida
2005/0284887 A1 12/2005 Lewis et al.
2006/0032871 A1 2/2006 Ophardt
2006/0076364 A1 4/2006 Stark
2006/0175354 A1 8/2006 Ophardt
2006/0178657 A1 12/2006 Roatis
2006/0273114 A1 12/2006 Ophardt
2007/0023454 A1 2/2007 Ophardt
2007/0158367 A1 7/2007 Lin
2007/0172369 A1 7/2007 Boermann
2007/0215643 A1 9/2007 Law
2007/0257064 A1 11/2007 Ophardt
2008/0035223 A1 2/2008 Ritsche
2008/0141635 A1 6/2008 Clerget
2008/0149666 A1 6/2008 LaFamme et al.
2008/0272148 A1 11/2008 Malik et al.
2008/0314931 A1 12/2008 van der Heljden
2009/0001100 A1 1/2009 van der Heijden
2009/0184134 A1 7/2009 Ciavarella
2009/0188944 A1 7/2009 Ciavarella et al.
2009/0200337 A1 8/2009 Quinlan
2009/0200338 A1 8/2009 Quinlan et al.
2009/0308894 A1 12/2009 Ophardt et al.
2009/0314806 A1 12/2009 Ray
2010/0096412 A1 4/2010 Law
2010/0213220 A1 8/2010 Laible
2011/0014076 A1 1/2011 Shi et al.
2011/0031278 A1 2/2011 Hande Man
2011/0079614 A1 4/2011 Ganzeboom et al.
2011/0089198 A1 4/2011 Leuliet
2011/0139825 A1 6/2011 Houghton
2011/0174840 A1 7/2011 Law et al.
2011/0303762 A1* 12/2011 Wegelin ..... B05B 7/0037 239/102.2
2012/0067923 A1 3/2012 Matthews et al.
2012/0074171 A1 3/2012 Quinlan
2012/0111891 A1 5/2012 McNulty
2012/0160879 A1 6/2012 Ciavarella
2012/0285992 A1 11/2012 Ciavarella
2013/0015209 A1 1/2013 Smith
2013/0037573 A1 2/2013 Spiegelberg
2013/0037575 A1 2/2013 van der Molen
2013/0043280 A1 2/2013 Hagleitner
2013/0056497 A1 3/2013 McNulty
2013/0094983 A1 4/2013 Pelfrey
2013/0112716 A1 5/2013 Law
2013/0119083 A1 5/2013 Ophardt
2013/0140380 A1 6/2013 Pelfrey
2013/0200073 A1 8/2013 Dong
2013/0206794 A1 8/2013 McNulty
2013/0214007 A1* 8/2013 Simonian ..... B65D 51/1644 222/189.06
2013/0299517 A1* 11/2013 Ciavarella ..... B05B 7/0037 222/190
2013/0299518 A1 11/2013 McNulty
2013/0315031 A1 11/2013 Bunoz et al.
2013/0320043 A1 12/2013 McNulty
2014/0034679 A1* 2/2014 Fitzpatrick ..... A47K 5/16 222/190
2014/0054320 A1 2/2014 Harris
2014/0054322 A1 2/2014 McNulty
2014/0054323 A1 2/2014 McNulty
2014/0061245 A1 3/2014 McNulty et al.
2014/0061246 A1 3/2014 McNulty
2014/0117053 A1 5/2014 Ciavarella
2014/0203047 A1* 7/2014 McNulty ..... B05B 7/0025 222/190
2014/0205473 A1* 7/2014 Ciavarella ..... B65D 83/00 417/313
2014/0231462 A1 8/2014 Ray
2014/0263462 A1 9/2014 Quinlan
2014/0319180 A1 10/2014 Quinlan
2014/0367419 A1 12/2014 Harris
2015/0144661 A1 5/2015 Tepas
2015/0173568 A1* 6/2015 Harris ..... A47K 5/1211 222/190
2015/0196170 A1 7/2015 Harris
2015/0239644 A1 8/2015 Wells
2015/0251841 A1 9/2015 McNulty
2015/0251842 A1 9/2015 Rymer
2015/0297039 A1 10/2015 Harris
2015/0335208 A1 11/2015 Ciavarella
2015/0342421 A1 12/2015 Harris
2016/0029855 A1 2/2016 Harris
2017/0156550 A1 6/2017 Ciavarella
2017/0181584 A1 6/2017 Harris

FOREIGN PATENT DOCUMENTS

DE 102011107376 1/2013
EP 0613728 A2 1/1994
EP 1147818 10/2001
EP 2080464 7/2009
EP 2080560 7/2009
FR 2199588 A1 4/1974
GB 7855 * 10/1905
GB 1269545 4/1972
GB 2301812 12/1996
GB 2472235 2/2011
WO 98/18563 A1 5/1998
WO 2006075196 A1 7/2006
WO 2011157975 12/2011

OTHER PUBLICATIONS

European Patent Office Search Report dated Jan. 7, 2011 in EP Application No. 09 150 880.2; 4 pages.
International Search Report and Written Opinion from International Application No. PCT/US2014/067030 dated Feb. 4, 2015.
International Search Report and Written Opinion from International Application No. PCT/US2014/055065 dated Dec. 12, 2014.
Office Action from U.S. Appl. No. 14/327,975 dated Feb. 12, 2016.
Office Action from U.S. Appl. No. 14/484,328 dated Feb. 1, 2016.
Office Action from U.S. Appl. No. 14/584,444 dated Mar. 28, 2016.

* cited by examiner

VENTED NON-COLLAPSING CONTAINERS, DISPENSERS AND REFILL UNITS HAVING VENTED NON-COLLAPSING CONTAINERS

RELATED APPLICATIONS

This non-provisional utility patent application claims priority to and the benefits of U.S. Provisional Patent Application Ser. No. 61/943,678, filed on Feb. 24, 2014, and entitled VENTED NON-COLLAPSING CONTAINERS, DISPENSERS AND REFILL UNITS HAVING VENTED NON-COLLAPSING CONTAINERS, which application is incorporated herein by reference in its entirety.

TECHNICAL FIELD

The present invention relates generally to liquid dispenser systems and more particularly to air-vented liquid dispensers, and refill units for use with such dispensers.

BACKGROUND OF THE INVENTION

Liquid dispenser systems, such as liquid soap and sanitizer dispensers, provide a user with an amount of liquid upon actuation of the dispenser. It is desirable to provide such a dispenser having a rigid container that is vented with air so that the pump may re-prime itself after a dispensing action. It is also desirable to provide such a dispenser that is easily recharged once the container runs out of liquid to dispense, and that is inexpensive to produce. Many prior art venting systems for containers leak when placed in an inverted position wherein the container of liquid is located above the pump. In addition, many prior art venting systems also leak when they are intermittently exposed to liquid.

SUMMARY

Exemplary embodiments of dispensers and refill units are disclosed herein. An exemplary refill unit for a soap, sanitizer or lotion includes a non-collapsing container. The non-collapsing container includes a neck. An annular projection is located at least partially on the neck. A one-way valve is located proximate the annular projection. The one-way valve allows air to flow into the non-collapsing container once the vacuum pressure in the container reaches the cracking pressure of the one-way valve and the one-way valve prevents liquid from flowing out of the annular projection. In addition, a pump for pumping the contents of the container out of the container is also included.

An exemplary refill unit for a soap, sanitizer or lotion includes a non-collapsing container. The non-collapsing container includes a neck and an air inlet located at least partially on the neck. A one-way valve is located proximate the air inlet. The one-way valve allows air to flow into the non-collapsing container once the vacuum pressure in the container reaches the cracking pressure of the one-way valve and the one-way valve prevents liquid from flowing out of the annular projection; and a pump for pumping the contents of the container out of the container.

An exemplary dispenser includes a housing, an actuator connected to the housing for causing the dispenser to dispose a fluid; and a refill unit. The refill unit includes a non-collapsing container that has a neck. An air inlet is located proximate the neck. A one-way valve located proximate the air inlet. The one-way valve allows air to flow into the non-collapsing container once the vacuum pressure in the container reaches the cracking pressure of the one-way valve and the one-way valve prevents liquid from flowing out of the annular projection; and the refill unit includes a pump for pumping the contents of the container out of the container.

In this way, a simple and economical refill unit with a container vent located between the air pump chamber and the container are provided.

BRIEF DESCRIPTION OF THE DRAWINGS

These and other features and advantages of the present invention will become better understood with regard to the following description and accompanying drawings in which.

DETAILED DESCRIPTION

Figure 1:
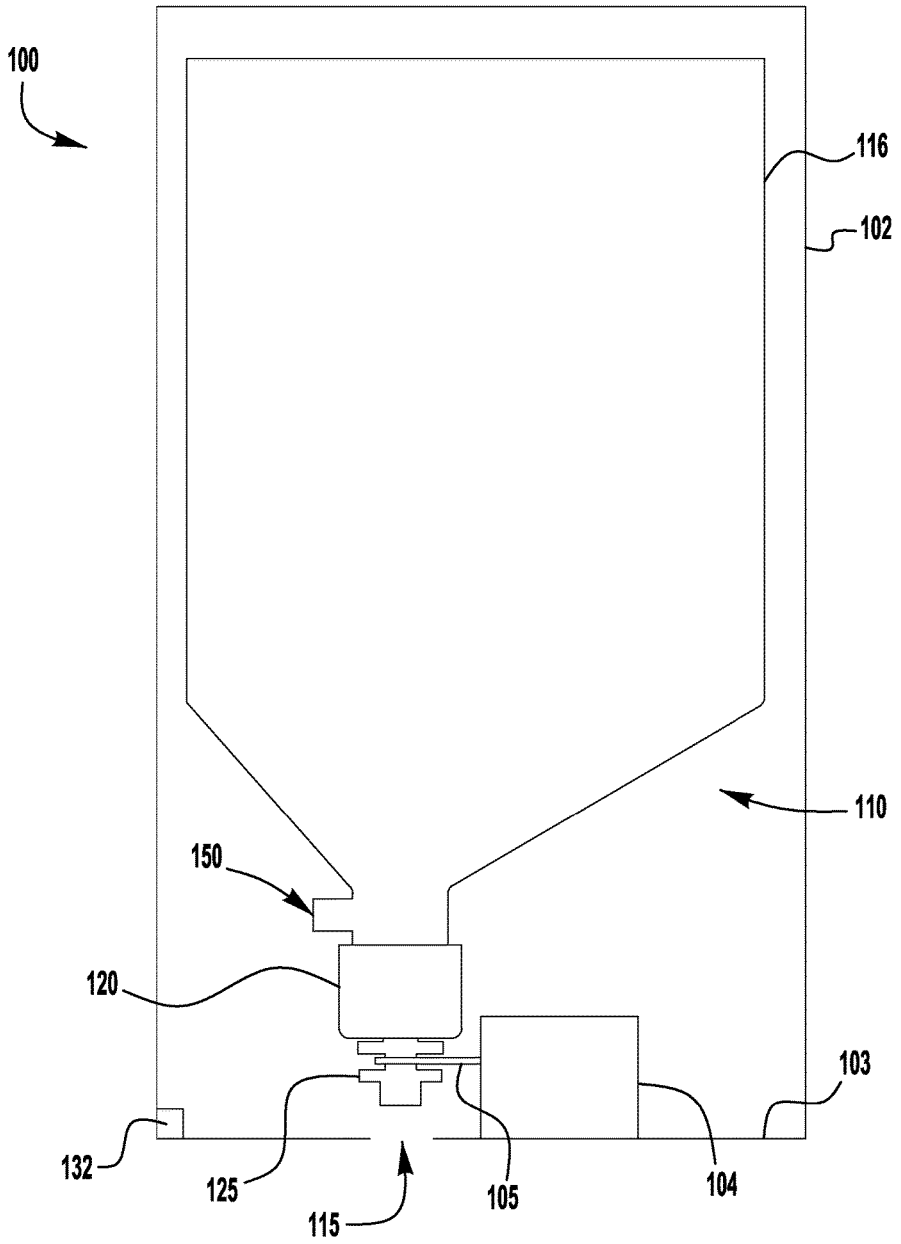
FIG. 1 is a cross-section of an exemplary liquid dispenser having a refill unit with a vertical pump.

FIG. 1 illustrates an exemplary embodiment of a dispenser 100 with a vertically operated pump 120. The cross-section of FIG. 1 is taken through the housing 102 to show the pump 120 and container 116. Dispenser 100 includes a disposable refill unit 110. The disposable refill unit 110 includes a container 116 connected to pump 120. The dispenser 100 may be a wall-mounted system, a counter-mounted system, an un-mounted portable system movable from place to place or any other kind of liquid dispenser system. In this particular embodiment, dispenser 100 is a foam dispenser; however, the inventive venting system disclosed herein may be used in liquid dispenser systems or foam dispenser systems. In addition, although embodiments contain vertically actuated pumps, the inventive system works equally well with other types of pumps, such as, for example, horizontally actuated pumps.

Container 116 includes a neck 117. A venting assembly 150 provides venting air to container 116 through a side of neck 117. In this exemplary embodiment, venting assembly 150 is located in the neck 117 or a portion of the preform that is not blow molded during manufacture of the container. Venting assembly 150 is discussed in more detail below.

The container 116 forms a liquid reservoir that contains a supply of foamable liquid within the disposable refill unit 110. In various embodiments, the contained liquid could be, for example, a soap, a sanitizer, a cleanser, a disinfectant, a lotion or the like. In the exemplary disposable refill unit 110, the container 116 is a non-collapsing container and can be made of thin plastic or like material. The container 116 may advantageously be refillable, replaceable or both refillable and replaceable. In some embodiments, the liquids may be non-foamable or non-foaming liquids.

In the event the liquid stored in the container 116 of the installed disposable refill unit 110 runs out or the installed refill unit 110 otherwise has a failure, the installed refill unit 110 may be removed from the foam dispenser 100. The empty or failed disposable refill unit 110 may then be replaced with a new disposable refill unit 110.

The housing 102 of the dispenser 100 contains one or more actuating members 104 to activate the pump 120. As used herein, actuator or actuating members or mechanisms include one or more parts that cause the dispenser 100 to move liquid, air or foam. Actuator 104 is generically illustrated because there are many different kinds of pump actuators which may be employed in the foam dispenser 100. The actuator 104 of the foam dispenser 100 may be any type of actuator such as, for example, a manual lever, a manual pull bar, a manual push bar, a manual rotatable crank, an electrically activated actuator or other means for actuating the pump 120. Electronic actuators may additionally include a sensor 132 for detecting the presence of an object and to provide for a hands-free dispenser system with touchless operation. Various intermediate linkages, such as for example linkage 105, connect the actuator member 104 to the pump 120 within the system housing 102. An aperture 115 is located in bottom plate 103 of housing 102 and allows liquid dispensed from the nozzle 125 of pump 120 to be dispensed to a user.

Exemplary foam pumps are disclosed in U.S. Pat. No. 8,272,539 filed on Dec. 3, 2008 and entitled Angled Slot Foam Dispenser, which is incorporated herein by reference in its entirety. In some embodiments, pump 120 is a liquid pump. An exemplary liquid pump is disclosed in U.S. Pat. No. 8,002,150 filed on Jul. 30, 2007 and entitled Split Engagement Flange For Soap Dispenser Pump Piston, which is incorporated herein by reference in its entirety.

Figure 2:
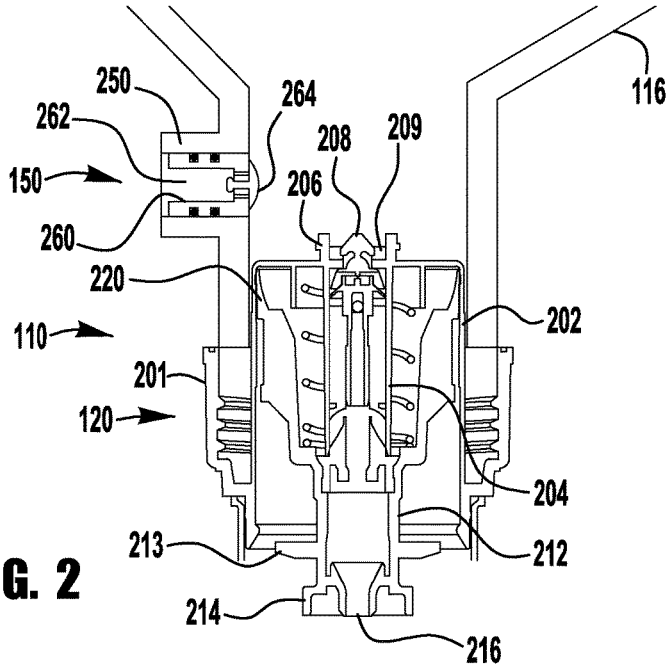
FIGS. 2 and 3 are partial cross-sections of the exemplary refill unit.
Figure 3:
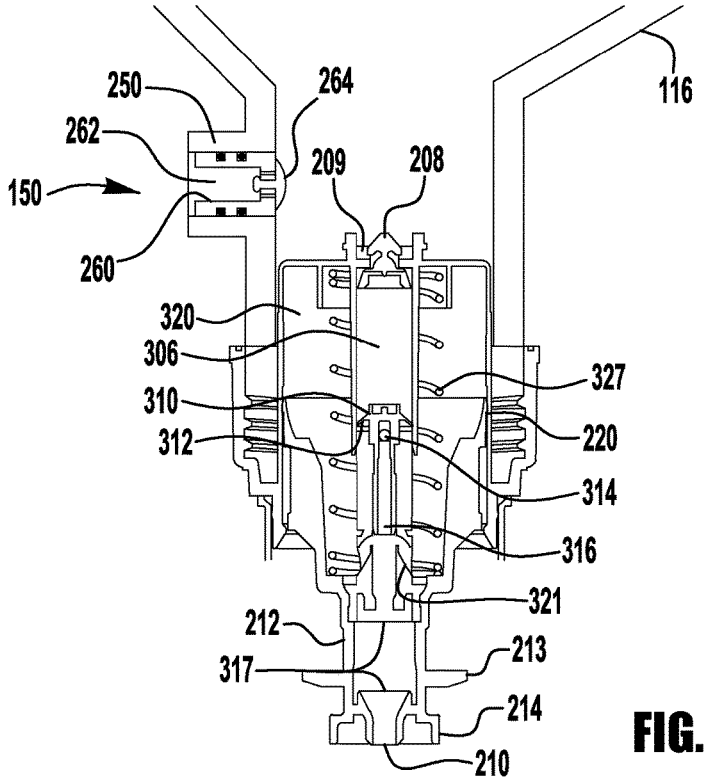

FIGS. 2 and 3 are partial cross-sections of an exemplary embodiment of refill unit 110. Foam pump 120 includes a collar 201 that connects to the neck 117 of container 116. Collar 201 may connect to neck 117 of container 116 in any manner such as for example a threaded connection, a snap fit connection, a friction fit connection or the like.

Foam pump 120 includes a cylindrical housing 202 that fits at least partially within neck 117. Foam pump 120 includes an inner cylindrical housing 204. In addition, housing 202 includes a first annular projection or shroud 206 and an aperture 209. Shroud 206 may be extended to any suitable length. In some embodiments, shroud 206 is sized so that air entering non-collapsing container 116 is not drawn into liquid pump chamber 306 through aperture 209. Aperture 209 extends from inside the container 116 into liquid pump chamber 306. A liquid inlet valve 208 is located within aperture 209. Liquid inlet valve 208 is a one-way valve that allows liquid to flow from the container 116 into liquid pump chamber 306. Liquid inlet valve 208 may be any type of one-way valve, such as for example, a wiper valve, ball and spring valve, an umbrella valve, a flapper valve or the like.

Foam pump 120 includes a piston 212. Piston 212 has a first engagement member 213 and a second engagement member 214. First engagement member 213 and second engagement member 214 engages an actuator 105 (FIG. 1) to move piston 212 upward and downward. Piston 212 includes an air piston seal 220 and a liquid piston seal 310. Piston 212 also includes a sealing member 312. In addition, piston 212 includes an aperture that is located between liquid piston seal 310 in seal 312 and extends to the interior of piston 212. Piston 212 has a hollow interior 316 from aperture 314 to outlet to 216. In addition foam pump 120 includes a biasing member 327 to bias piston 212 in the downward direction.

Neck 117 of container 116 includes a annular projection 250. Annular projection 250 is hollow and provides a passage to the interior of the container. Annular projection 250 is located above foam pump 120. Annular projection 250 may be used to fill/refill container 116 or vent container 116.

Figure 4:
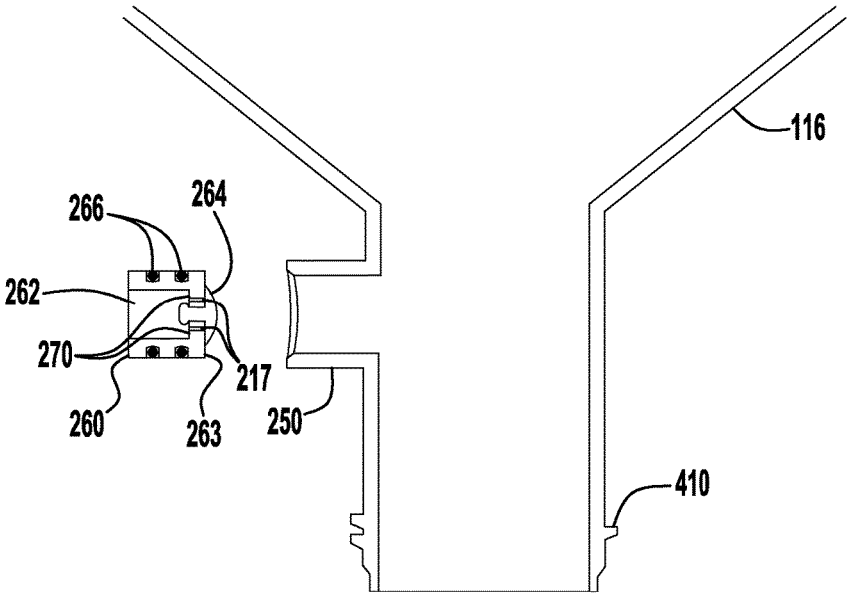
FIG. 4 is a cross-section of an exemplary container and venting assembly.

An valve insert 252, which is best seen in FIG. 4, includes a cylindrical body 260 having a first end 262 that is open and a second end 263 that includes one or more apertures 270 and has a one-way air inlet valve 264 connected thereto. One-way inlet valve 264 is an umbrella valve, however, one-way inlet valve 264 may be a different type of valve that allows air or liquid into the container 116 and prevents liquid from flowing out of container 116 through annular projection 250.

In some embodiments, it is desirable to have one-way inlet valve 264 remain in contact with the liquid in the container 116. Having the one-way inlet valve 264 in remain in contact with the liquid, prevents liquid from drying on, under or around one-way inlet valve 264 and causing one-way valve 264 to fail.

Insert 252 includes sealing members 266. Sealing members 266 may be, for example, o-rings. In addition, insert 252 may include one or more grooves to retain sealing members 266. Sealing members 266 provide a seal between insert 252 and annular projection 250 to prevent leaking. In some embodiments, sealing members 266 also retain insert 252 in annular projection 250. In some embodiments, insert 252 sealed to annular projection 250 by other means, such as, for example, adhesive, welding, friction or the like.

In some embodiments venting assembly 150 is located on an adaptor (not shown) that connects to the neck 117 of container 116. A pump 120 is connected to the adaptor (not shown). In some embodiments, the adaptor (not shown) connects the pump 120 to the container 116 neck 117.

FIG. 4 illustrates the exemplary container 116, neck 117 and annular projection 250. Neck 117 includes threads 410 for securing to cap 201. In addition, FIG. 4 illustrates insert 252 prior to being inserting insert 252 into annular projection 250. In some embodiments, annular projection 250 is used to fill/refill container 116. In some embodiments, insert 252 is removed, or prior to inserting insert 252 into annular projection 250 to fill container 116. In some embodiments, container 116 may be refilled through insert 252.

Figure 5:
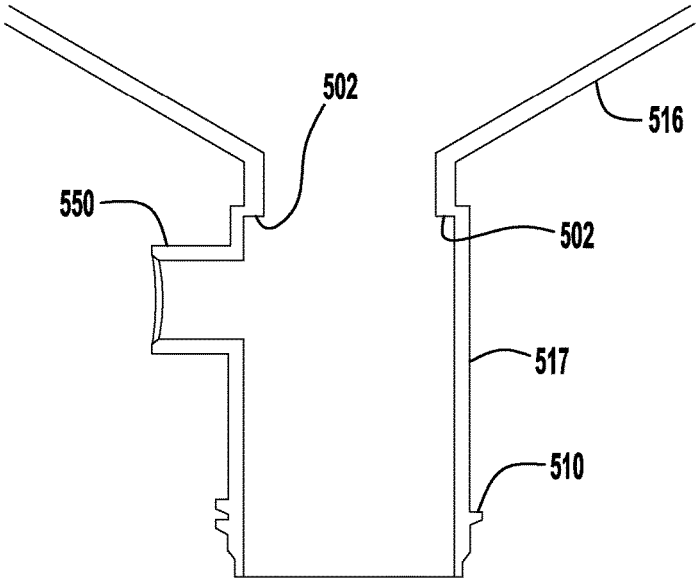
FIG. 5 is a cross-section of an exemplary container having a step for forming a seal with a spindle in a blow molding machine.

FIG. 5 illustrates another exemplary container 516 that includes a neck 517 and an annular projection 550 for receiving a venting insert (not shown) and/or for filling the container. Neck 517 includes threads 510 for connecting to a pump (not shown). Container 516 includes a step 502. Step 502 has an interior diameter that is smaller than the interior diameter of the neck 517. In some embodiments, step 502 provides a seal between a preform that contains the neck 517 and annular projection 550 and a spindle of the blow molding machine (not shown).

During operation, as piston 212 moves downward from the position shown in FIG. 2 to the position shown in FIG. 3, liquid flows from the container 116 past one-way liquid inlet valve 208 into liquid pump chamber 306. As air pump chamber 320 expands, air is drawn in through outlet 216 into air pump chamber 320.

During downward movement, a vacuum pressure builds up in container 116 due to the liquid being drawn into liquid chamber 30. Once the vacuum pressure becomes greater than the cracking pressure of one-way valve 264, the vacuum pressure causes air to flow through the passage in insert 252 and past one-way valve 264 into the container 116. Once the vacuum pressure drops below the cracking pressure of one-way valve 264, one-way valve 264 seats and creates a seal that prevents liquid from flowing out of container 116 through insert 252.

When foam pump 120 moves from the position shown in FIG. 3 upward to the position shown in FIG. 2, liquid in pump chamber 306 flows past liquid outlet seal 310 through aperture 314 and down outlet passage 316. Simultaneously, air flows from air pump chamber 320 through passage 321 and into passage 316 where it mixes with the liquid. The liquid and air mixture in passage 316 is forced through screens 317. The turbulence caused by the screens creates a rich foam that is forced out of outlet 216.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. An inverted refill unit for a soap, sanitizer or lotion comprising:

a non-collapsing container;

the non-collapsing container having a neck located at a bottom of the container when in use, wherein the neck comprises a side wall and an opening;

an annular projection disposed on the side wall of the neck, wherein the annular projection comprises an air inlet that extends through the side wall of the neck;

a one-way valve disposed in the air inlet, wherein the one-way valve allows air to flow into the non-collapsing container through the air inlet when the vacuum pressure in the container reaches the cracking pressure of the one-way valve, and wherein the one-way valve prevents liquid from flowing out of the air inlet; and a pump for pumping the contents of the container out of the non-collapsing container through the opening of the neck, wherein the pump comprises a liquid inlet that is substantially perpendicular to the air inlet of the annular projection.

2. The refill unit of claim 1 further comprising an insert, wherein the one-way valve is connected to the insert which is inserted in the annular projection.

3. The refill unit of claim 2 further comprising one or more sealing members around the insert for forming a seal between the insert and the annular projection.

4. The refill unit of claim 1 wherein the one-way valve is in contact with fluid when fluid is in the non-collapsing container.

5. The refill unit of claim 1 wherein the container is used in an inverted position and the neck is located at the bottom of the container.

6. The refill unit of claim 1 wherein the pump is actuated vertically.

7. An inverted refill unit for a soap, sanitizer or lotion comprising:

a non-collapsing container;

the non-collapsing container having a neck located at a bottom of the container when in use, wherein the neck comprises a side wall and an opening;

an inlet extending through a side wall of the neck;

a one-way valve located proximate the inlet, wherein the one-way valve allows air to flow into the non-collapsing container through the inlet when the vacuum pressure in the container reaches the cracking pressure of the one-way valve, and wherein the one-way valve prevents liquid from flowing out of the inlet; and a pump for pumping the contents of the container out of the container, wherein the pump comprises a liquid inlet that is substantially perpendicular to the inlet extending through the side wall of the neck.

8. The refill unit of claim 7 further comprising an insert, wherein the one-way valve is connected to the insert which is inserted in the inlet.

9. The refill unit of claim 8 further comprising one or more sealing members around the insert for forming a seal between the insert and the inlet.

10. The refill unit of claim 7 wherein the one-way valve is in contact with fluid when fluid is in the container.

11. The refill unit of claim 7 wherein the pump is a foam pump.

12. A dispenser comprising:

a housing;

an actuator connected to the housing for causing the dispenser to dispose a fluid; and an inverted refill unit; wherein the inverted refill unit comprises;

a non-collapsing container;

the non-collapsing container having a neck located at a bottom of the container when in use, wherein the neck comprises a side wall and an opening;

an inlet extending through the side wall of the neck;

a one-way valve located proximate the inlet, wherein the one-way valve allows air to flow into the non-collapsing container through the inlet when the vacuum pressure in the container reaches the cracking pressure of the one-way valve, and wherein the one-way valve prevents liquid from flowing out of the inlet;

a pump for pumping the contents of the container out of the container, wherein the pump comprises a liquid inlet that is substantially perpendicular to the inlet extending through the side wall of the neck.

13. The dispenser of claim 12 wherein the inlet is an annular projection.

14. The dispenser of claim 12 wherein the one-way inlet valve is connected to an insert that is inserted in the inlet.

15. The dispenser of claim 12 further comprising an insert that is inserted in the inlet and wherein the insert includes a cylindrical member and the one-way valve is secured to the cylindrical member.

16. The dispenser of claim 15 further comprising a sealing member around the cylindrical member for sealing the cylindrical member to the inlet.

17. The dispenser of claim 12 wherein the one-way valve is in contact with fluid in the container during use.

18. The refill unit of claim 1 wherein the annular projection is located above the liquid inlet when in use.

19. The refill unit of claim 7 wherein the inlet extending through the side wall of the neck is located above the liquid inlet of the pump when in use.

20. The refill unit of claim 7, wherein the inlet extending through the side wall of the neck is used to fill the non-collapsing container with soap, sanitizer or lotion.

21. The refill unit of claim 12 the inlet extending through the side wall of the neck is located above the liquid inlet of the pump when in use.

22. The refill unit of claim 12 wherein the inlet extending through the side wall of the neck is used to fill the non-collapsing container with a fluid.

* * * * *